US006729713B2

(12) United States Patent
Shirakawa

(10) Patent No.: US 6,729,713 B2
(45) Date of Patent: May 4, 2004

(54) INK JET RECORDING APPARATUS, INK JET RECORDING METHOD AND INK JET RECORDING HEAD

(75) Inventor: Hiroaki Shirakawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/026,893

(22) Filed: Dec. 27, 2001

(65) Prior Publication Data

US 2002/0093545 A1 Jul. 18, 2002

(30) Foreign Application Priority Data

Dec. 28, 2000 (JP) ..... 2000-400963

(51) Int. Cl.[7] ..... B41J 2/21
(52) U.S. Cl. ..... 347/43; 347/15; 347/40
(58) Field of Search ..... 347/15, 43, 40, 347/12, 56, 65

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,825,377 A | * | 10/1998 | Gotoh et al. | 347/15 |
| 6,382,757 B1 | * | 5/2002 | Kakutani | 347/15 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 2738697 | 1/1998 |

* cited by examiner

*Primary Examiner*—Lamson Nguyen
(74) *Attorney, Agent, or Firm*—Fitzpatrick, Cella, Harper & Scinto

(57) ABSTRACT

The present invention is purposed to restrain temperature increase of a recording head by decreasing the preponderance of heat generation of the recording head. In order to accomplish the object, ink discharging units (Bk, C, M) having lower average printing duties are positioned between each of ink discharging units (LC, LM, Y) having higher average printing duties. Therefore, the preponderance of heat generation of the recording head during recording is decreased so that the temperature increase of the recording head may be efficiently restrained.

10 Claims, 6 Drawing Sheets

FIG. 3

| IMAGE | C | M | Y | Bk | LC | LM | SUM |
|---|---|---|---|---|---|---|---|
| SAMPLE 1 | 5.84 | 8.23 | 22.25 | 7.02 | 54.17 | 57.48 | 155.0 |
| SAMPLE 2 | 9.24 | 9.54 | 30.42 | 1.32 | 75.00 | 79.88 | 205.4 |
| SAMPLE 3 | 4.77 | 3.9 | 18.77 | 1.57 | 102.13 | 73.01 | 204.2 |
| SAMPLE 4 | 3.11 | 10.72 | 34.27 | 0.61 | 80.76 | 91.88 | 221.4 |
| SAMPLE 5 | 9.54 | 33.1 | 36.94 | 42.7 | 34.17 | 31.00 | 187.5 |
| SAMPLE 6 | 14.88 | 16.06 | 14.02 | 98.4 | 0.43 | 0.00 | 143.8 |
| SAMPLE 7 | 8.71 | 10.76 | 29.96 | 4.95 | 64.12 | 59.05 | 177.6 |
| SAMPLE 8 | 28.26 | 11.83 | 25.19 | 46.44 | 24.29 | 30.48 | 166.5 |
| SAMPLE 9 | 10.54 | 11.73 | 23.79 | 0.45 | 80.87 | 63.52 | 190.9 |
| SAMPLE 10 | 6.58 | 13.96 | 21.88 | 14.33 | 45.05 | 57.69 | 159.5 |
| SAMPLE 11 | 5.19 | 7.25 | 18.78 | 2.77 | 32.43 | 35.83 | 102.2 |
| AVERAGE | 9.7 | 12.5 | 25.1 | 20.1 | 53.9 | 52.7 | 174.0 |

INK JET RECORDING APPARATUS, INK JET RECORDING METHOD AND INK JET RECORDING HEAD

BACKGROUND OF THE INVENTION

1. Field of the Invention

The present invention relates to ink jet recording apparatus, ink jet recording method and ink jet recording head for carrying out recording by discharging ink from a recording head to a recording medium.

2. Related Background Art

The recording apparatus such as a printer, copying machine or facsimile machine is configured to record an image composed of dotted pattern on a recording medium such as a paper or plastic film on the basis of image information. Such a recording apparatus can be classified into ink jet type, wire-dot type, thermal type, laser-beam type and so on. Among them, the ink jet type (ink jet recording apparatus) discharges and flies ink (recording liquid) drops from a discharge orifice of the recording head so that the drops are attached to the recording medium for recording.

In the ink jet recording apparatus, particularly in a bubble-jet type, the recording head is heated by heat generation of a heater. If the temperature of the head is excessively increased, there may be caused various adverse effects such as that the ink cannot be discharged, scorch or degradation of the heater is accelerated, the density of ink recorded on the recording medium can be changed, or the like, so therefore many measures are taken into consideration to restrict the temperature increase of the recording head.

The most general measure for restricting the temperature increase is to give a cessation term during scanning when the recording heat reaches a predetermined temperature so as to radiate heat during the term. However, this method causes a net printing speed to be reduced less than a real printing speed (driving frequency) of the recording head.

In addition, it is useful to use a fan for cooling the heated head due to the heat generation during printing, and an example to fix a fan to a carriage of the recording head is well known. However, if fixing the fan to the carriage, the carriage becomes weighted, which makes it difficult to increase the driving frequency, and as the ink drops become smaller, declination of the shot position is concerned due to its wind during printing.

And, it may be considered to use a method of cooling with liquid. As for that, there is a proposal as below.

For example, Japanese Patent No. 2,738,697 discloses a bubble-jet type liquid ejecting recording head, which, for example, installs a cooling means to a heat energy working section, winds a tube around the liquid ejecting recording head, and makes a cooling liquid flow through the tube so as to attempt stabilization of discharging performance the ink drops.

However, such a conventional example has a complex flow structure of the cooling liquid, so accompanying troubles in manufacturing, and it should be considered how to supply, change and discard the cooling liquid.

SUMMARY OF THE INVENTION

An object of the present invention is to provide ink jet recording apparatus, ink jet recording method and ink jet recording head, which may efficiently restrict the temperature rise of the heating head by eliminating deviation of heat generation of the recording head without any structural change in a cooling means of the recording head.

Thus, the present invention to achieve the object provides an ink jet recording method for carrying out the recording by using ink discharging units corresponding to a plurality of colors, which generate thermal energy in discharging the ink, wherein said ink discharging units corresponding to a plurality of colors has, at least for two colors among the colors, a dark ink discharging unit for discharging a dark ink with a relatively high density in a same color group and a light ink discharging unit for discharging a light ink with a relatively low density, said ink discharging units corresponding to a plurality of colors are arranged in an order to a predetermined direction so that at least other ink discharging unit is positioned between the light ink discharging units corresponding to said two color.

And, the present invention provides an ink jet recording method for carrying out the recording by using ink discharging units corresponding to a plurality of colors, which generate thermal energy in discharging the ink, wherein said ink discharging units corresponding to a plurality of colors has, at least for two colors among the colors, a dark ink discharging unit for discharging a dark ink with a relatively high density in a same color group and a light ink discharging unit for discharging a light ink with a relatively low density, said ink discharging units corresponding to a plurality of colors are arranged in an order to a predetermined direction so that the light ink discharging units corresponding to said two color are separately positioned not to be adjacent to each other.

In addition, the present invention provides an ink jet recording method for carrying out the recording by using a plurality of ink discharging units, which generate thermal energy in discharging the ink, wherein said plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and yellow (Y) ink discharging unit, said ink discharging units are arranged in an order to a predetermined direction so that the light magenta (LM) ink discharging unit, the light cyan (LC) ink discharging unit and the yellow (Y) ink discharging unit are separately positioned not to be adjacent to each other.

The present invention also provides an ink jet recording head for carrying out the recording by using ink discharging units corresponding to a plurality of colors, which generate thermal energy in discharging the ink, wherein said ink discharging units corresponding to a plurality of colors has, at least for two colors among the colors, a dark ink discharging unit for discharging a dark ink with a relatively high density in a same color group and a light ink discharging unit for discharging a light ink with a relatively low density, said ink discharging units corresponding to a plurality of colors are arranged in an order to a predetermined direction so that at least other ink discharging unit is positioned between the light ink discharging units corresponding to said two color.

And, the present invention also provides an ink jet recording head for carrying out the recording by using ink discharging units corresponding to a plurality of colors, which generate thermal energy in discharging the ink, wherein said ink discharging units corresponding to a plurality of colors has, at least for two colors among the colors, a dark ink discharging unit for discharging a dark ink with a relatively high density in a same color group and a light ink discharging unit for discharging a light ink with a relatively low density, said ink discharging units corresponding to a plurality of colors are arranged in an order to a predetermined direction so that the light ink discharging units corresponding to said two color are separately positioned not to be adjacent to each other.

Moreover, the present invention provides an ink jet recording head for carrying out the recording by using a plurality of ink discharging units, which generate thermal energy in discharging the ink, wherein said plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and yellow (Y) ink discharging unit, said ink discharging units are arranged in an order to a predetermined direction so that the light magenta (LM) ink discharging unit, the light cyan (LC) ink discharging unit and the yellow (Y) ink discharging unit are separately positioned not to be adjacent to each other.

BRIEF DESCRIPTION OF THE DRAWINGS

FIG. 3 is a drawing in which colors of the ink and its printing duties for several colors are analyzed.

DETAILED DESCRIPTION OF THE PREFERRED EMBODIMENTS

Hereinafter, embodiments of the present invention are described with reference to the accompanying drawings.

Figure 5:
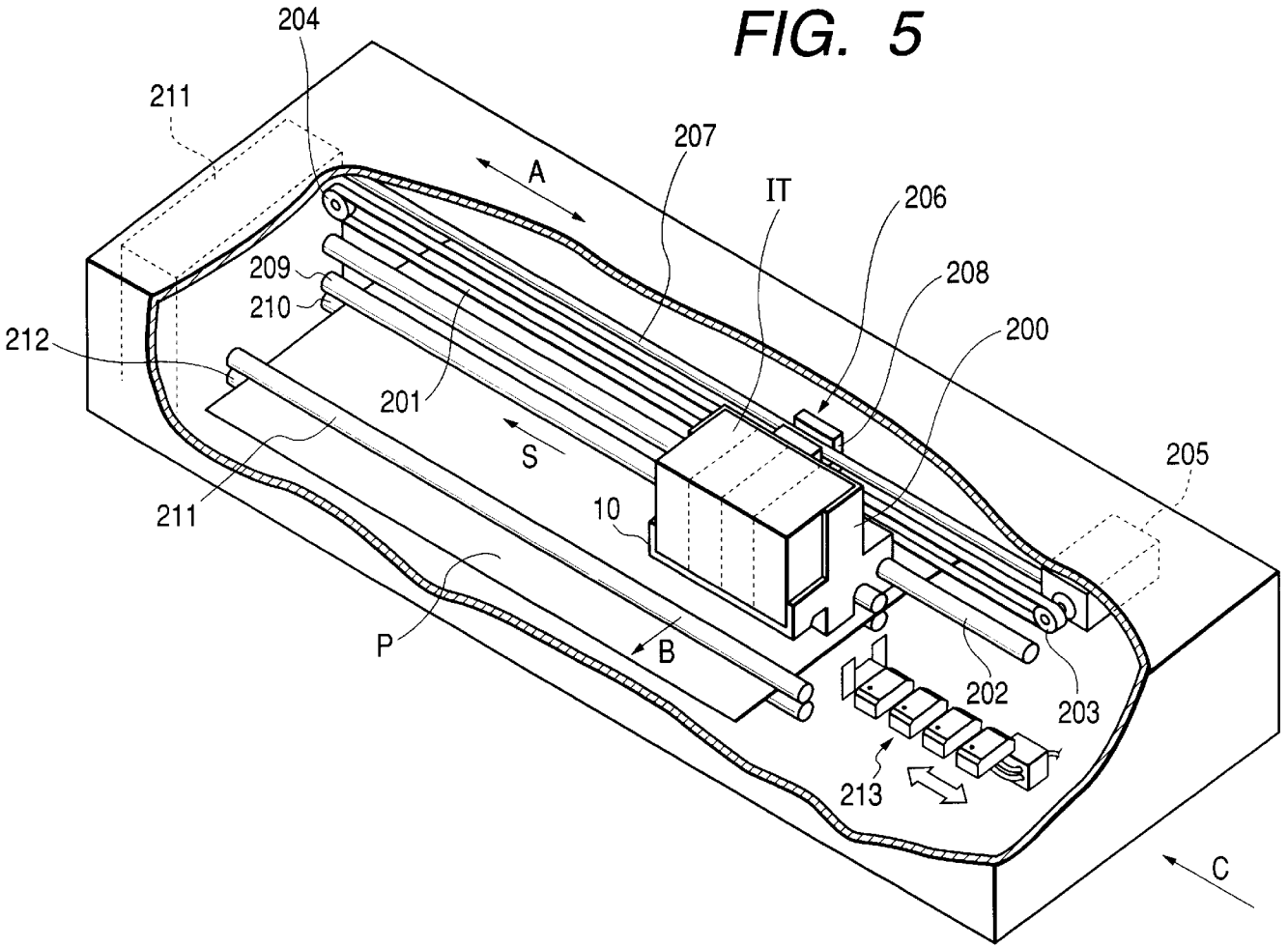
FIG. 5 is a partially sectional perspective view showing an ink jet recording apparatus.

FIG. 5 is a partially sectional perspective view showing a general configuration of an ink jet recording apparatus. In the ink jet recording apparatus, a carriage 200 is fixed to an endless belt 201 and it is movable along a guide shaft 202. The endless belt 201 is wound around pulleys 203, 204. To the pulley 203, a driving axis of a carriage driving motor 205 is connected. Therefore, the carriage 200 is scanned in a reciprocating direction (A direction) along the guide shaft 202 by rotational drive force of the motor 205. In the carriage 200, included are a recording head 10, in which a plurality of discharging nozzles are mounted in series, and an ink tank (IT) acting as a container to receive ink.

To the recording head 10, a plurality of ink discharging orifices are formed on a surface opposite to a paper (P) as a recording medium, in series along to a carried direction of the paper (P). The recording head 10 has ink paths, each of which is communicated with each of the discharging orifices, and an electro-thermal converter to generate thermal energy for ink discharge corresponding to each ink path. The electro-thermal converter generates the thermal energy with electric pulses applied according to driving data, the thermal energy being transmitted to the ink to generate film boiling at the ink, thereby the ink being discharged through the discharging orifices with accompanying with generation of the bubbles. To each ink path, a common liquid chamber communicating with the ink path is mounted, and this common liquid chamber is connected to the ink tank (IT).

And, the recording head 10, not limited to that case, may employ a type of using a piezoelectric element, which similarly generates thermal energy. In addition, in this apparatus, a linear encoder 206 is installed to detect a moving position of the carriage or the like. That is, a linear scale 207 is provided along a moving direction of the carriage 200, and slits are formed on the linear scale 207 at regular intervals to have 1200 slits for each inch. On the other hand, a slit detector 208 having, for example, a light-emitting unit and a light-receiving sensor (or photo sensor), and a signal processing circuit are installed in the carriage 200. Therefore, the encoder 206 outputs a discharge timing signal indicating an ink discharge timing and a position information of the carriage as the carriage 200 moves. If the ink is discharged whenever the slit is detected, it becomes possible to carry out printing to a main scanning direction at a resolution of 1200 dpi.

The recording paper (P) acting as the recording medium is intermittently carried to an arrow direction (B) rectangular to a scanning direction of the carriage 200. The recording paper (P) is supported by a pair of roller units 209, 210 at an upstream side and a pair of roller units 211, 212 at a downstream side, and carried with ensuring the planarity to the head 10 by receiving a constant tension. In this case, the driving force to each roller unit is applied from a paper feeding motor, not shown.

In such a configuration, by accompanying the movement of the carriage 200, the printing is carried out to the whole paper (P) with repeating to print for a width corresponding to a width of arrangement of the discharging orifices and supply the paper (P) in turns.

The carriage 200 is stopped at a home position as required at start of recording or during recording. At this home position, a cap member 213 is prepared for capping a discharging side of each head, and the cap member 213 is connected to a suction recovering means (not shown) for preventing clogging of the discharging orifices by compulsorily sucking the ink from the discharging orifices.

Figure 6:
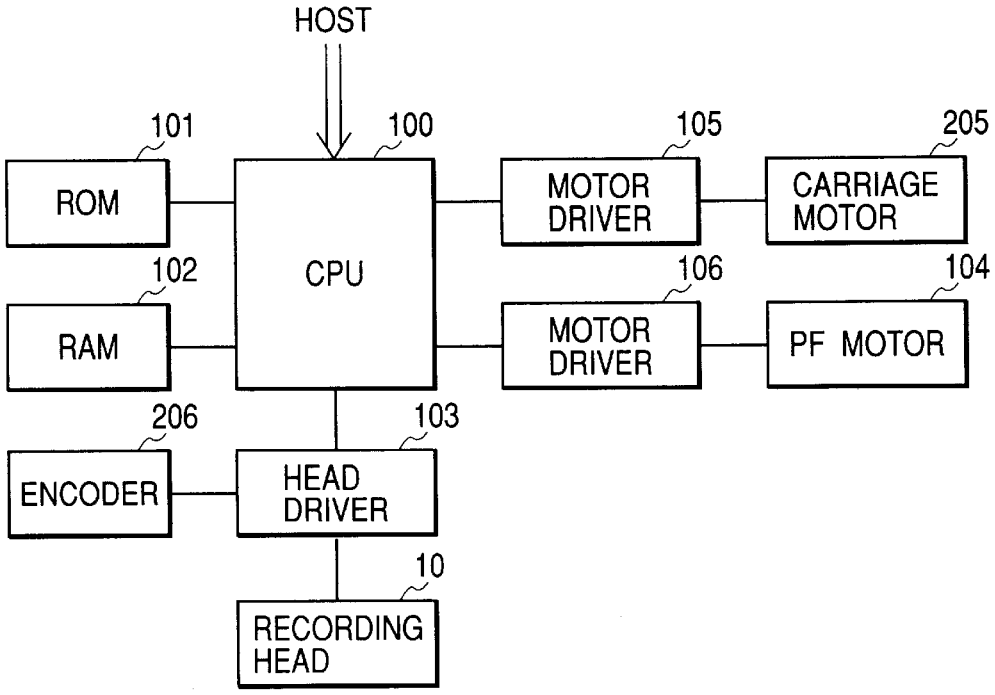
FIG. 6 is a block diagram showing the configuration of a control system in the ink jet recording apparatus.

FIG. 6 is a block diagram showing a configuration of a control system of the ink jet recording apparatus.

When receiving the printing information from a host apparatus, a CPU 100 carries out the control of each unit in the recording apparatus and data processing. A ROM 101 stores processing programs on process procedures, and a RAM 102 is used as a work area during carrying out the process procedures. That is, based on the control program stored in the ROM 101, the CPU 100 processes the printing information received from the host apparatus with use of peripheral units such as the RAM 102 so on, and carries out the processes such as conversion of the information into printing data. Also, the CPU 100 outputs driving data of the electro-thermal converter, i.e. the printing data, and a drive control signal to a head driver 103. The head driver 103 drives the electro-thermal converter of the recording head 10 on the basis of the input driving data.

In addition, the CPU 100 controls the carriage driving motor 205 for reciprocating the carriage 200 and a paper feeding (PF) motor 104 for feeding the recording paper (P) through respective motor driver 105, 106. The head driver 103 receives the discharge timing signal and the carriage position information from the encoder 206.

Figure 7:
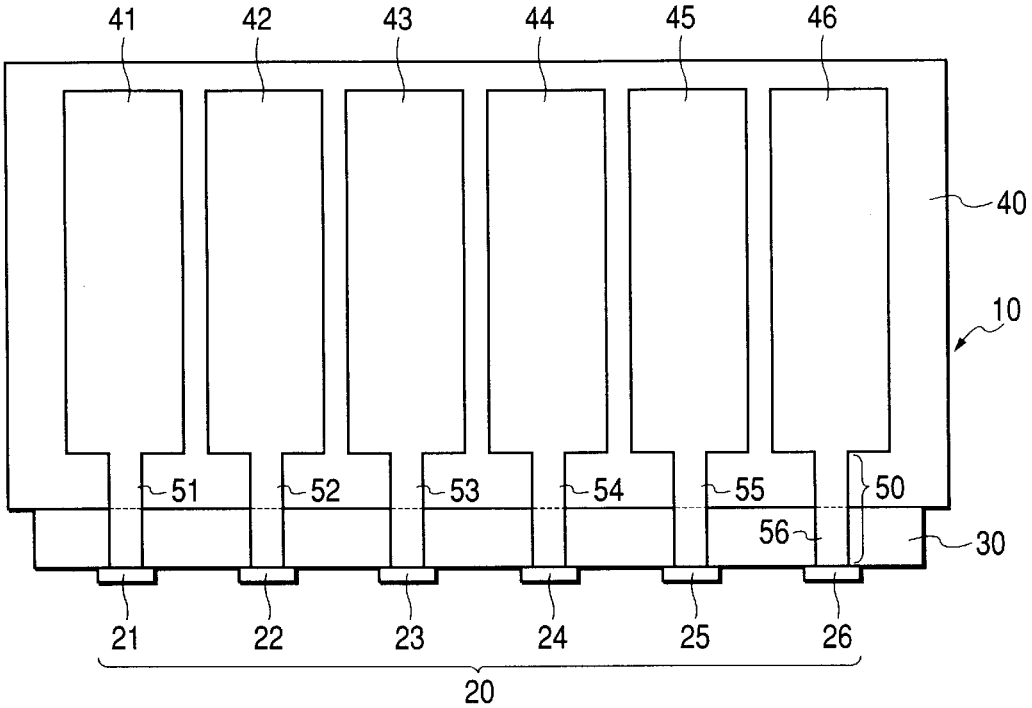
FIG. 7 is a view illustrating an arrangement manner in a main scanning direction of a plurality of ink discharging units of an ink jet recording head.

FIG. 7 is for illustrating a section of the recording head of the ink jet recording apparatus. The recording head 10 briefly includes a chip (ink discharging unit) 20 forming the discharging orifices, a chip plate 30 for fixing the chip, and a mold 40 forming an ink tank. The chip includes 6 color parts 21 to 26, which are connected to corresponding 6 color ink tanks 41 to 46 through ink channels 51 to 56. The ink stored in the ink tank 41 to 46 is supplied to the chips 21 to 26 via the ink channels 51 to 56, discharged from the discharging orifices formed at the chips 21 to 26, and then recorded on the recording medium.

Figure 1:
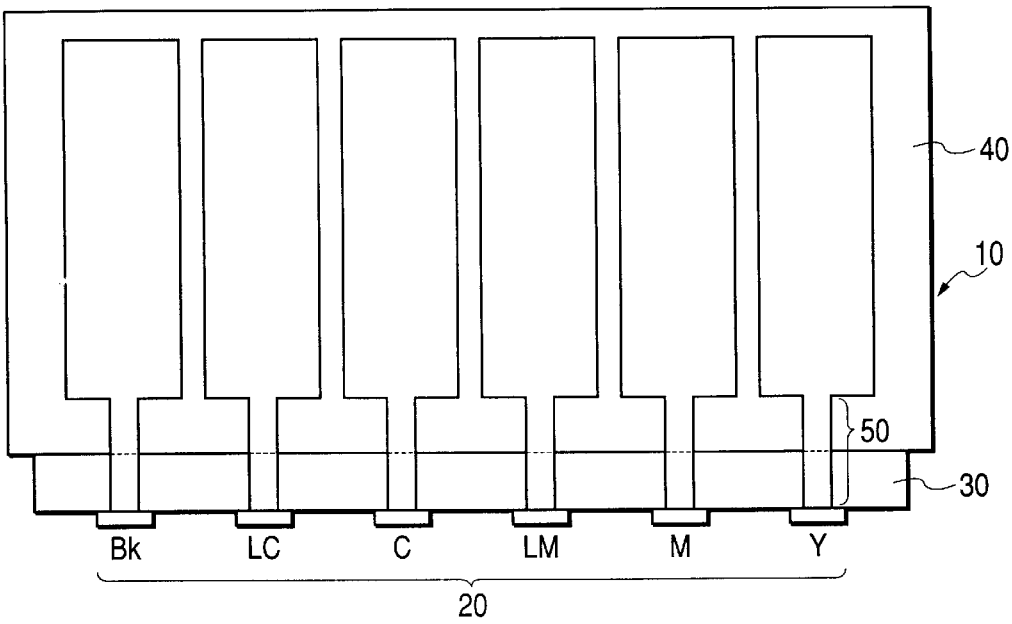
FIG. 1 is a sectional view of an ink jet recording head showing in an order of arrangement of ink discharging units of several colors according to a first embodiment of the present invention.
Figure 2:
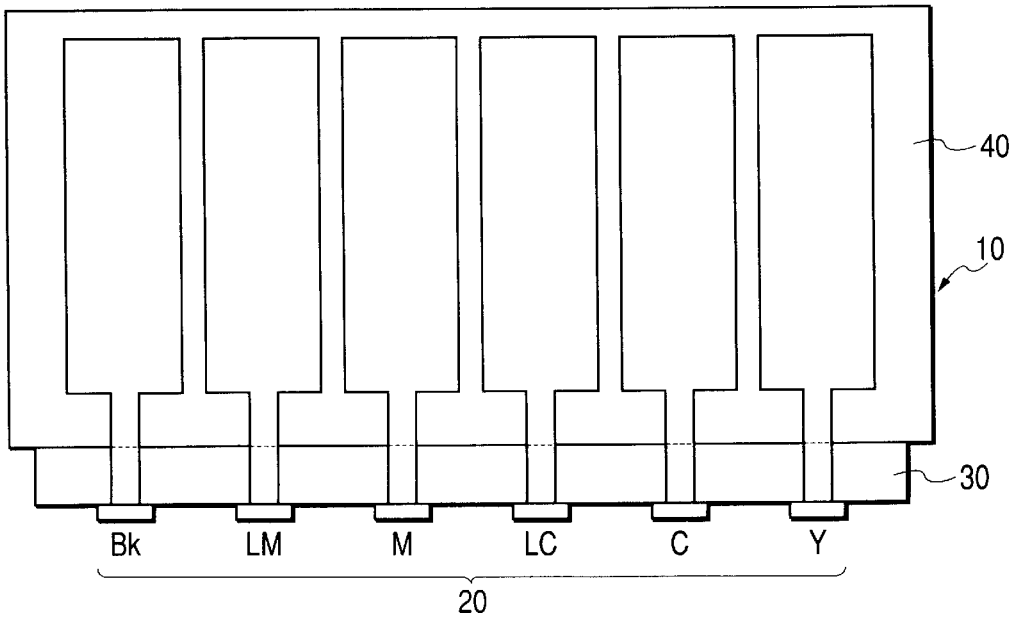
FIG. 2 is a sectional view of an ink jet recording head showing in an order of arrangement of ink discharging units of several colors according to a second embodiment of the present invention.
Figure 4:
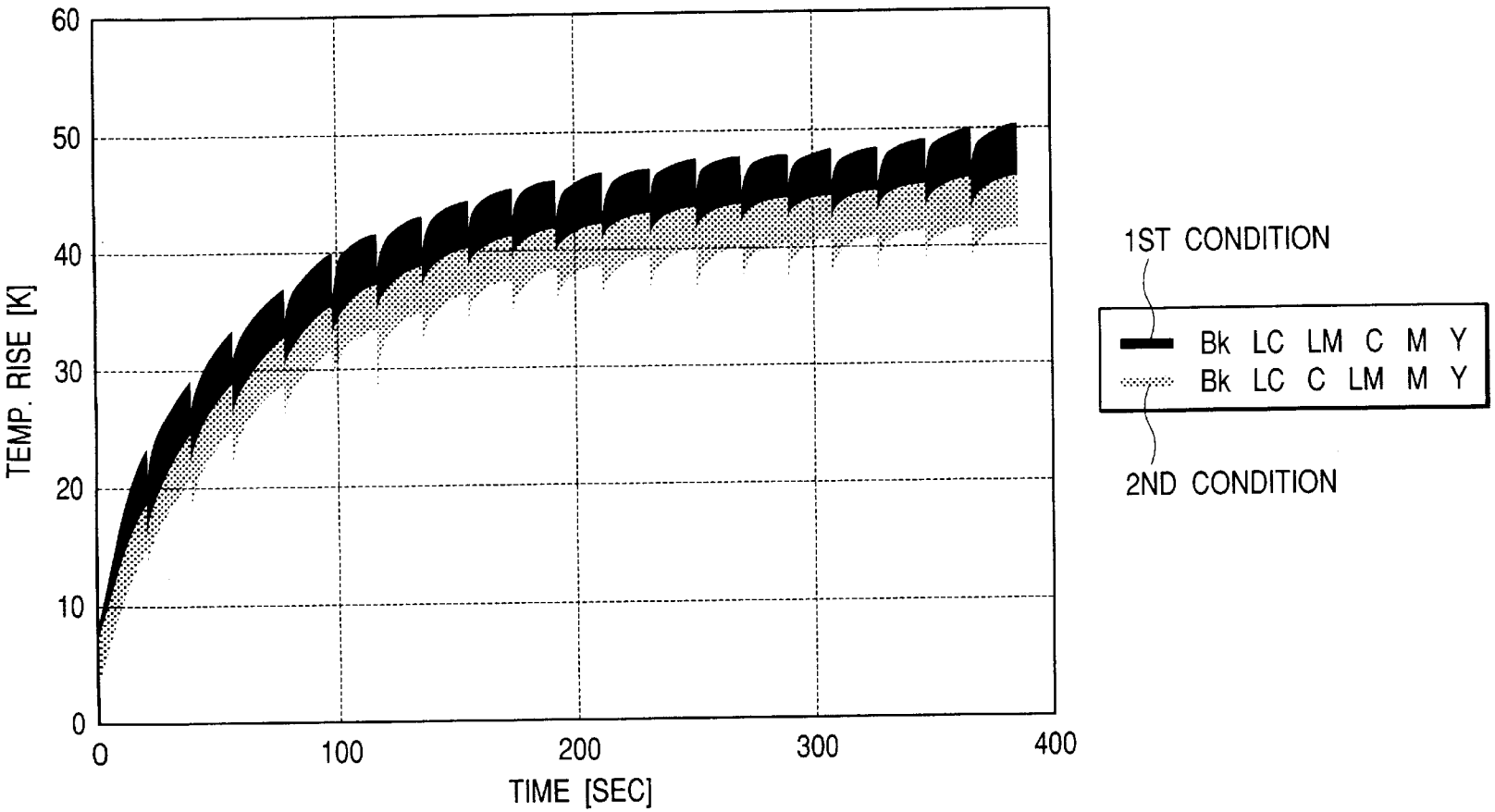
FIG. 4 shows the relation between an arrangement order of ink discharging units and a temperature rise regarding the elapse of time.

FIG. 1 and FIG. 2 are drawings best showing characteristics of the first and second embodiments of the present invention. Each unit designated by each reference number is basically identical to that of FIG. 7. FIG. 3 and FIG. 4 are drawings for describing the first and second embodiments, respectively. FIG. 3 is to resolve 11 kinds of different image samples extracted at random into 6 colors, obtain the printing duty (what percentage of ink is discharged per a unit time for the whole unit printing area) of each color, and then calculate an average value. Referring to this FIG. 3, though depending on the image sample also, it would be understood that the averaged printing duty is decreased in an order of LC (light cyan), LM (light magenta), Y (yellow), Bk (black), M (dark or deep magenta) and C (dark or deep cyan). That is, the ink consumption per a unit time and the heat-generation amount per a unit time in each color ink discharging unit are higher in an order of an LC ink discharging unit discharging the LC ink, an LM ink discharging unit discharging the LM ink, a Y ink discharging unit discharging the Y ink, a Bk ink discharging unit discharging the Bk ink, an M ink discharging unit discharging the M ink, and a C ink discharging unit discharging the C ink.

Now, FIG. 4 gives measured results, in the ink jet recording apparatus using a recording head with color ink discharging units discharging 6 color inks (LC, LM, Y, Bk, M, C), showing how much the temperature increase of the recording head varies as the arranging order of each ink discharging unit is changed. According to the arranging orders along the main scanning direction as shown in the right drawing of FIG. 4, after multiplying a heating load to an average value of the duties for each color as shown in FIG. 3, the change in temperature rise of the recording head as the time elapses is measured when printing 20 sheets of A4 papers. As a result, on the first condition that the ink discharging units are arranged in an order of Bk, LC, LM, C, M and Y, since the highest two ink discharging units regarding the printing duty (the LC ink discharging unit and the LM ink discharging unit) are adjacent to each other, the temperature rise is great, while on the second condition that the ink discharging units are arranged in an order of Bk, LC, C, LM, C, M and Y, since at least another ink discharging unit is arranged between the highest two ink discharging units (the LC ink discharging unit and the LM ink discharging unit), the temperature rise is restrained. That is, by spacing two chips of the LC and LM inks of the highest two printing duties, it can be a mechanism for restraining the temperature increase. Such an arranging order of the ink discharging units can be thought in various types, and representative examples are shown in FIG. 1 and FIG. 2.

And, as shown in FIG. 3, the ink having the highest printing duty except the LM and LC inks is the Y ink. Therefore, on consideration of more effectively restraining the temperature increase of the recording head, it is preferably to not only separate the highest two ink discharging units (the LC ink discharging unit and the LM ink discharging unit) but also separate the Y ink discharging unit having the third temperature increase from the highest two ink discharging units. That is, the head temperature increase can be restrained more effectively by positioning the highest three ink discharging units (for LC, LM and Y inks) not to be adjacent to each other, and arranging the lowest three ink discharging units (for Bk, C and M inks) between each of the highest three ink discharging units (for LC, LM and Y inks). That is, by adopting the configuration that the chips of three LC, LM and Y inks having the highest printing duties are separately positioned, more effective restraint for the temperature increase can be realized, compared to the configuration that the chips of only two LC and LM inks having the highest two printing duties. In addition, in FIG. 1 and FIG. 2, it is shown that the lowest three colors (Bk, C, M) are positioned between each of the highest three colors (LC, LM, Y).

Figure 8:
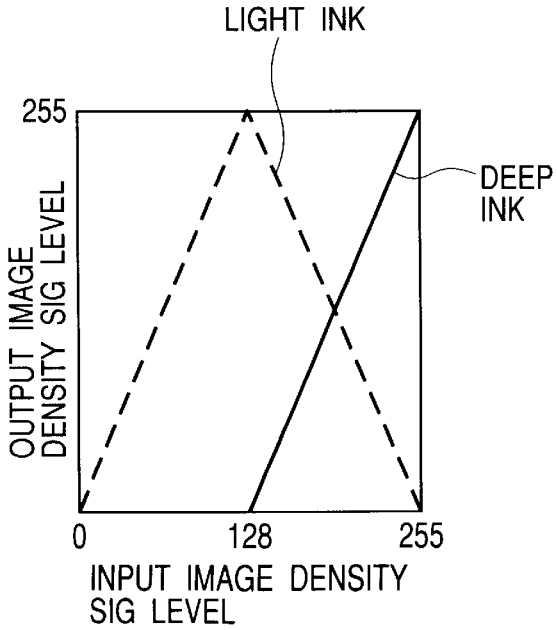
FIG. 8 is a view illustrating an image signal process in case of using 2 kinds of shading inks with different color densities in a same color group.

As described above, the two inks of the highest printing duties are LC (light cyan) and LM (light magenta), and they are all light inks. The reason of the lighter ink having a higher printing duty is guessed that a higher amount of the light ink should be used to print an image than that of dark ink. FIG. 8 shows the image signal processing in case of using two kinds (light and dark) of inks with different color densities in a same color group. As definitely shown in FIG. 8, if a density level of an input image density signal is 0 to 128, only light ink is used, but if the density level of an input image density signal is 128 to 255, a lower amount of the light ink is used in accordance with the density level increases, and a corresponding amount of the dark ink is increasingly used. That is, because the light ink (an ink having a relatively low density for a same color group) is used other than the density level 255, while the dark ink (an ink having a relatively high density for a same color group) is used only within the density levels 128 to 255, the higher amount of the light ink is liable to be used. Therefore, the light ink has higher printing duty than the dark ink though the inks in a same color group but having different densities are used, and as a result, the head temperature increase is greater in the light ink discharging unit than in the dark ink discharging unit. As it can be easily understood, in case of using the light and dark inks for plural colors (e.g. cyan and magenta), the head temperature increase can be efficiently restrained by positioning ink discharging units for light inks separately not to be adjacent to each other, and then positioning the other discharging units (e.g. the C ink discharging unit, the M ink discharging unit, the Y ink discharging unit, the Bk ink discharging unit) between the light color ink discharging units (e.g. the LC ink discharging unit and the LM ink discharging unit).

As described above, by using a dark ink with a relatively high density and a light ink with a relatively low density in a same color group for at least two colors (e.g. C, M) among plural colors (e.g. C, M, Y, Bk) used in the embodiment of the present invention, and then positioning at least one other ink discharging unit between the light ink discharging units discharging each light ink (e.g. LC, LM), the head temperature increase can be efficiently restrained. As an example, in case of using 6 kinds of ink discharging units of Bk, LC, LM, C, M and Y, it is preferred to position at least one other ink discharging unit (at least one of the C ink discharging unit, the M ink discharging unit, the Y ink discharging unit and the Bk ink discharging unit) between the LC ink discharging unit and the LM ink discharging unit. They are preferably arranged in an order of Bk, LC, C, LC, M, Y as shown in FIG. 1, or in an order of Bk, LM, M, LC, C, Y as shown in FIG. 2. And, in view of the Y ink having the highest printing duty except the LM and LC inks, it is more preferred to arrange the Y ink discharging unit to be separated from the LC ink discharging unit and the LM ink discharging unit. In other words, by arranging the lowest three colors (Bk, C, M) between each of the highest three colors (LC, LM, Y), the head warm-up may be more efficiently restrained.

And, though it is described based on the case of using 6 kinds of Bk, LC, LM, C, M, and Y inks, the used ink is not limited to those 6 kinds. For example, the light and dark inks may be used not only for cyan (C) and magenta (M) but also for black (Bk) and yellow (Y). In this case, it is preferable that each discharging unit of the light cyan (LC), the light magenta (LM) and the light black (LBk) is arranged not to be adjacent to each other.

The present invention particularly gives excellent effects in a recording deice using an ink jet type recording head, which forms flying droplets and carries out printing by using thermal energy, among ink jet recording methods.

Its typical configuration and principle are preferably referred to the basic principle disclosed in U.S. Pat. No. 4,723,129 and U.S. Pat. No. 4,740,796. This principle, though it can be applied to any of so-called on-demand type and continuous type, is effective in the on-demand type because, by applying at least one driving signal, which endows rapid temperature increase corresponding to recording information and exceeding nucleus boiling to an electro-thermal converter positioned corresponding to a liquid path or a sheet on which the liquid (ink) is maintained, it may generate thermal energy in the electro-thermal converter, generate film boiling on a heat-applied surface of the recording head, and therefore form bubbles in the liquid (ink) in one-to-one relation with the driving signal. By discharging the liquid (ink) through the discharging orifices owing to expansion and contraction of the bubbles, it forms at least one drop. It is also more preferable to make the driving signal in a pulse form, because it is possibly to discharge the liquid (ink) having excellent response characteristics by expanding and contracting the bubbles promptly. A suitable one as such a pulse-type driving signal is disclosed in U.S. Pat. No. 4,463,359 and U.S. Pat. No. 4,345,262. And, if adopting a condition mentioned in U.S. Pat. No. 4,313,124, which is related to a temperature increase ratio of the heat-applied surface, more excellent recording can be realized.

As for the recording head, besides the associations of the discharging orifices, the liquid paths and the electro-thermal converters disclosed in the above-described Patent applications, configurations using techniques of U.S. Pat. No. 4,558,333 and U.S. Pat. No. 4,459,600 disclosing that the heat-applied unit is positioned on a curved portion are also included in the present invention. Moreover, as for the plural electro-thermal converters, same effects may be obtained in configurations based on Japanese Patent Laid-Open No. 59-123670 disclosing that a common slit is used as a discharging unit of the electro-thermal converter and Japanese Patent Laid-Open No. 59-138461 disclosing that an opening absorbing a pressure wave of the thermal energy is corresponded to the disclosing unit. In other words, though configured in any type of the recording head, the recording may be surely efficiently carried out according to the present invention.

In addition, though configured in a parallel type like the above example, a recording head fixed to a main body of the apparatus, a changeable chip-type recording head fixed to the main body to enable to supply ink from the main body, or a cartridge-type recording head having an ink tank integrally mounted to the recording head itself, the present invention will do.

Moreover, though described in the embodiment of the present invention as the ink is liquid, an ink, which is solidified at a room temperature or below, can be used, and because the temperature of the ink itself of the ink jet type is adjusted in a range between 30° C. and 70° C. so that the viscosity of the ink is within a stable discharging range, it is also preferred that the ink is in a liquid state when applying a use recording signal. In addition, by using a state changing energy of the ink from a solid state to a liquid state, it is also suitable to use an ink, which is solidified when it is left along but becomes liquefied by heating in order to actively prevent the temperature increase due to the thermal energy or to prevent vaporization of the ink. Though they all liquefy the ink discharge the liquefied ink by endowment according to the recording signal of the thermal energy, the present invention is also applied to the case of using ink, which has a characteristic of not being liquefied till the thermal energy is endowed. In this case, the ink may be formed opposite to the electro-thermal converter, in a state of maintaining its liquid or solid state in a porous sheet recesses or orifices, as disclosed in Japanese Patent Laid-Open Nos. 54-56847 or 60-71260. In the present invention, more effective for each above-described ink is to carry out the above-described film boiling.

And, as for a shape of the ink jet recording apparatus of the present invention, not only the type used as an image output terminal of an information processing equipment such as a computer but also a copying machine associated with, such as, a reader or further a facsimile apparatus with signal transmitting and receiving functions may be adopted.

As described above, according to the present invention, it is possible to decrease the preponderance of heat generation due to the recording of the recording head having a plurality of ink discharging units, and therefore restrain the temperature increase of the recording head.

What is claimed is:

1. An ink jet recording apparatus for carrying out recording by using a plurality of ink discharging units, which generate thermal energy for discharging ink, wherein said plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and a yellow (Y) ink discharging unit, and wherein said ink discharging units are arranged in an order in a predetermined direction so that the light magenta (LM) ink discharging unit and the light cyan (LC) ink discharging unit are positioned so as not to be adjacent to each other, and at least one of the light magenta (LM) ink discharging unit and the light cyan (LC) ink discharging unit is positioned so as to be adjacent to the black (BK) ink discharging unit.

2. The ink jet recording apparatus according to claim 1, wherein said ink discharging units are arranged in an order of the black (Bk) ink discharging unit, the light cyan (LC) ink discharging unit, the dark cyan (C) ink discharging unit, the light magenta (LM) ink discharging unit, the dark magenta (M) ink discharging unit and the yellow (Y) ink discharging unit.

3. The ink jet recording apparatus according to claim 1, wherein said ink discharging units are arranged in an order of the black (Bk) ink discharging unit, the light magenta (LM) ink discharging unit, the dark magenta (M) ink discharging unit, the light cyan (LC) ink discharging unit, the dark cyan (C) ink discharging unit and the yellow (Y) ink discharging unit.

4. An ink jet recording method for carrying out recording by using a plurality of ink discharging units, which generate thermal energy for discharging ink, wherein the plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and a yellow (Y) ink discharging unit, and wherein the ink discharging units are arranged in an order in a predetermined direction so that the light magenta (LM) ink discharging unit and the light cyan (LC) ink discharging unit are positioned so as not to be adjacent to each other, and at least one of the light magenta (LM) ink discharging unit and the light cyan (LC) ink discharging unit is positioned so as to be adjacent to the black (BK) ink discharging unit.

5. The ink jet recording method according to claim 4, wherein the ink discharging units are arranged in an order of the black (Bk) ink discharging unit, the light cyan (LC) ink discharging unit, the dark cyan (C) ink discharging unit, the light magenta (LM) ink discharging unit, the dark magenta (M) ink discharging unit and the yellow (Y) ink discharging unit.

6. The ink jet recording method according to claim 4, wherein the ink discharging units are arranged in an order of the black (Bk) ink discharging unit, the light magenta (LM) ink discharging unit, the dark magenta (M) ink discharging unit, the light cyan (LC) ink discharging unit, the dark cyan (C) ink discharging unit and the yellow (Y) ink discharging unit.

7. An ink jet recording head for carrying out recording by using a plurality of ink discharging units, which generate thermal energy for discharging ink, wherein said plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and a yellow (Y) ink discharging unit, and wherein said ink discharging units are arranged in an order in a predetermined direction so that the light magenta (LM) ink discharging unit and the light cyan (LC) ink discharging unit are positioned so as not to be adjacent to each other, and at least one of the light magenta (LM) ink discharging unit and the light cyan (LC) ink discharging unit is positioned so as to be adjacent to the black (BK) ink discharging unit.

8. An ink jet recording apparatus for carrying out recording by using a plurality of ink discharging units, which generate thermal energy for discharging ink, wherein said plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and a yellow (Y) ink discharging unit, and wherein said ink discharging units are arranged in an order in a predetermined direction so that (1) between the light magenta (LM) ink discharging unit and the light cyan (LC) ink discharging unit, at least one other ink discharging unit is positioned, (2) between the light magenta (LM) ink discharging unit and the yellow (Y) ink discharging unit, at least one other ink discharging unit is positioned, and (3) between the light cyan (LC) ink discharging unit and the yellow (Y) ink discharging unit, at least one other ink discharging unit is positioned, wherein the black (BK) ink discharging unit is positioned so as to be adjacent to at least one of the light magenta (LM) ink discharging unit and the light cyan (LC) ink discharging unit.

9. An ink jet recording method for carrying out recording by using a plurality of ink discharging units, which generate thermal energy for discharging ink, wherein the plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and a yellow (Y) ink discharging unit, and wherein the ink discharging units are arranged in an order in a predetermined direction so that (1) between the light magenta (LM) ink discharging unit and the light cyan (LC) ink discharging unit, at least one other ink discharging unit is positioned, (2) between the light magenta (LM) ink discharging unit and the yellow (Y) ink discharging unit, at least one other ink discharging unit is positioned, and (3) between the light cyan (LC) ink discharging unit and the yellow (Y) ink discharging unit, at least one other ink discharging unit is positioned, wherein the black (BK) ink discharging unit is positioned so as to be adjacent to at least one of the light magenta (LM) ink discharging unit and the light cyan (LC) ink discharging unit.

10. An ink jet recording head for carrying out recording by using a plurality of ink discharging units, which generate thermal energy for discharging ink, wherein said plurality of ink discharging units include a black (Bk) ink discharging unit, a light magenta (LM) ink discharging unit, a dark magenta (M) ink discharging unit, a light cyan (LC) ink discharging unit, a dark cyan (C) ink discharging unit and a yellow (Y) ink discharging unit, and wherein said ink discharging units are arranged in an order in a predetermined direction so that (1) between the light magenta (LM) ink discharging unit and the light cyan (LC) ink discharging unit, at least one other ink discharging unit is positioned, (2) between the light magenta (LM) ink discharging unit and the yellow (Y) ink discharging unit, at least one other ink discharging unit is positioned, and (3) between the light cyan (LC) ink discharging unit and the yellow (Y) ink discharging unit, at least one other ink discharging unit is positioned, wherein the black (BK) ink discharging unit is positioned so as to be adjacent to at least one of the light magenta (LM) ink discharging unit and the light cyan (LC) ink discharging unit.

* * * * *